US007510514B2

(12) United States Patent
Messerschmid et al.

(10) Patent No.: US 7,510,514 B2
(45) Date of Patent: Mar. 31, 2009

(54) APPARATUS FOR ROLLING A FRONT END OF A DEFORMABLE SLEEVE-SHAPED CONTAINER COVER

(75) Inventors: Uwe Messerschmid, Albershausen (DE); Michael Heil, Moenchengladbach (DE); Thomas Vetten, Duesseldorf (DE)

(73) Assignee: Michael Hoerauf Maschinenfabrik GmbH, Donzdorf (DE)

( * ) Notice: Subject to any disclaimer, the term of this patent is extended or adjusted under 35 U.S.C. 154(b) by 0 days.

(21) Appl. No.: 11/095,620

(22) Filed: Apr. 1, 2005

(65) Prior Publication Data

US 2005/0250637 A1 Nov. 10, 2005

(30) Foreign Application Priority Data

Apr. 2, 2004 (DE) ..... 10 2004 017 173

(51) Int. Cl.
*B31B 1/00* (2006.01)

(52) U.S. Cl. ..... 493/155; 493/158; 493/308; 493/52

(58) Field of Classification Search ..... 493/52, 493/58, 76, 107, 108, 135, 155, 158, 308
See application file for complete search history.

(56) References Cited

U.S. PATENT DOCUMENTS 1,175,406 A * 3/1916 Bohlman ..... 493/108
2,281,889 A * 5/1942 Stuart et al. ..... 229/5.7
3,065,677 A * 11/1962 Loeser ..... 425/393
3,318,203 A * 5/1967 Durat ..... 425/356
3,402,874 A * 9/1968 Sternau ..... 229/125.05
3,439,587 A * 4/1969 Sternau ..... 493/52
3,547,012 A * 12/1970 Nicholas et al. ..... 493/109
3,760,750 A * 9/1973 Rentmeester ..... 413/1
3,990,353 A * 11/1976 Richards et al. ..... 493/108
4,211,339 A * 7/1980 Itoh ..... 229/400
4,409,045 A * 10/1983 Busse ..... 156/69
4,452,596 A * 6/1984 Clauss et al. ..... 493/107
4,680,016 A 7/1987 Lynch
4,692,132 A * 9/1987 Ikushima et al. ..... 493/103
4,836,400 A * 6/1989 Chaffey et al. ..... 220/612

(Continued)

FOREIGN PATENT DOCUMENTS

EP 0 626 254 B1 11/1997

OTHER PUBLICATIONS

Chinese Office Action dated Nov. 9, 2007 (Sixteen (16) Pages).

*Primary Examiner*—Sameh H. Tawfik
(74) *Attorney, Agent, or Firm*—Crowell & Moring LLP

(57) ABSTRACT

An arrangement for rolling the frontal end of a deformable sleeve-shaped container jacket comprises a supporting surface which radially supports the container jacket in the area of its end. A ring-shaped cavity is arranged radially adjacent thereto, which cavity is closed at the bottom and open at the top. The cavity has an essentially semicircular cross-section. The cavity is provided in circumferential direction with a plurality of pocket-shaped recesses in the transitional area between the supporting surface and the bottom, between which recesses rolling ridges, as part of the original cavity surface, remain. The purpose of this design is to effect a reduction in the deformation forces when the frontal end of the container jacket is being rolled.

9 Claims, 4 Drawing Sheets

U.S. PATENT DOCUMENTS 5,226,585 A * 7/1993 Varano ..... 229/400
6,287,247 B1 * 9/2001 Dees et al. ..... 493/58
7,056,563 B2 * 6/2006 Halabisky ..... 428/34.2

* cited by examiner

APPARATUS FOR ROLLING A FRONT END OF A DEFORMABLE SLEEVE-SHAPED CONTAINER COVER

This application claims the priority of German document no. 10 2004 017 173.4, filed Apr. 2, 2005, the disclosure of which is expressly incorporated by reference herein.

BACKGROUND AND SUMMARY OF THE INVENTION

The present invention relates to an arrangement for rolling the frontal end of a deformable sleeve-shaped container jacket, comprising a supporting surface which radially supports the container jacket in the area of its end, also comprising, radially arranged to the supporting surface, a ring-shaped cavity having a closed bottom and an open top, which cavity has an essentially semicircular cross-section for acting axially on the end of the container jacket.

An arrangement of this type is prior art in European published patent 0 626 254. The cavity of the known arrangement comprises in circumferential direction a geometrically constant smooth surface, which, by means of axially pushing forward the frontal end of the deformable sleeve-shaped container jacket, effects the deforming process. Practical application has shown that a crease-free rolling of the frontal end of the container jacket by means of the above mentioned arrangement succeeds only when a lubricant, for example an oil, is used. There are, however, materials for the container jacket, for example certain types of paper, where the application of a lubricant is not desirable.

It is an object of the present invention, in the case of an arrangement of the above mentioned type, to realize the rolling of a frontal end of a container jacket without the use of any kind of lubricant.

This object has been achieved in accordance with the present invention in that the cavity is provided in the circumferential direction, at least in the transitional area between the supporting surface and the bottom, with a plurality of pocket-shaped recesses, between which rolling ridges, as part of the original cavity surface, remain.

In the embodiment according to the present invention, a closed rolling surface no longer acts on the frontal end of the container jacket, but rather a plurality of rolling ridges with larger or smaller widths. This causes the circulating line contact present in prior art to be interrupted according to the present invention, whereby the deformation forces during rolling are reduced by up to 40%. Even in the case of paper coated inside and outside, that is, in the case of thicker layers, no lubricant is necessary. Due to the reduced deformation forces, a coating of the rolling tool is also no longer necessary. Furthermore, because of the profiling of the arrangement according to the present invention, the setting accuracy during rolling can be lowered, whereby increased tolerances are permitted.

In the case of one variation, at least the cavity comprises a surface of plastic. Thus time-consuming re-working during the manufacture of deformation dies is superfluous. In addition, the use of plastic is a contributary factor to the omission of any kind of lubrication. It is, of course, possible to manufacture the whole arrangement out of plastic. Alternatively, in another embodiment, the arrangement can be made of another suitable material, for example aluminium.

The present invention has many varied applications. For example, the arrangement can be applied in the area of that end of the container jacket which is to form a flange around the edge of a container bottom to be inserted. Alternatively, the arrangement according to the present invention can be applied to the upper, open end of the container, in order, for example to produce a top lip, which may serve the attachment of a lid. In particular in the latter case, the rolling can take place in several stages with a plurality of similarly designed arrangements.

In one variation—based on a supporting surface supporting the container jacket on the inside—the cavity can be radially arranged on the outside. This variation serves in particular the formation of a lip which is rolled outwards, for example a top lip. The container jacket is hereby deflected outwards by the rolling ridges.

In a further variation—based on a supporting surface supporting the container jacket on the outside—the cavity can be radially attached inwards. This type of variation is used, for example, for forming a bottom flange of a container, whereby the container jacket is this time deflected inwards by means of the rolling ridges.

Depending on the particular application of the arrangement, the width of the recesses and the width of the rolling ridges can vary. In one case it can be purposeful when the width of the recesses correspond approximately to the width of the rolling ridges. In another case, it can be advantageous when the width of the recesses is several times the width of the rolling ridges. The pocket-like recesses themselves could extend out over the floor of the bottom and cover for example the entire cavity.

These and further objects, features and advantages of the present invention will become more readily apparent from the following detailed description thereof when taken in conjunction with the accompanying drawings wherein:

DETAILED DESCRIPTION OF THE DRAWINGS

Figure 1:
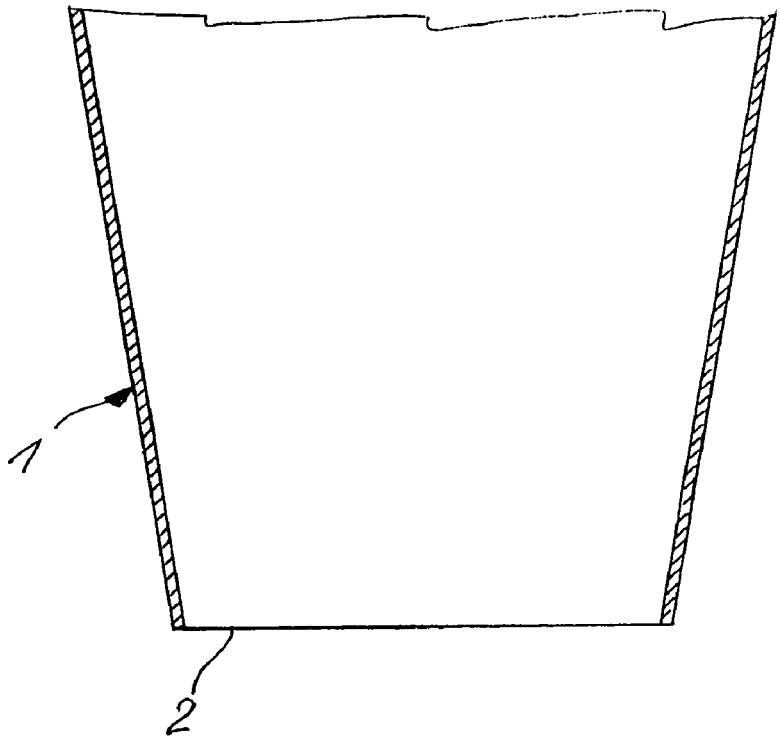
FIG. 1 is a deformable sleeve-shaped container jacket shown in axial section, whose frontal ends are to be rolled.

In FIG. 1, the lower area of a wound, sleeve-shaped, container jacket 1 is shown in axial section, which container jacket 1 is made, for example, of paper. The cross-section does not necessarily need to be circular. The lower frontal end 2 of the container jacket 1 is to be rolled, for example by means of forming a flange around the edge of a container bottom.

Figure 2:
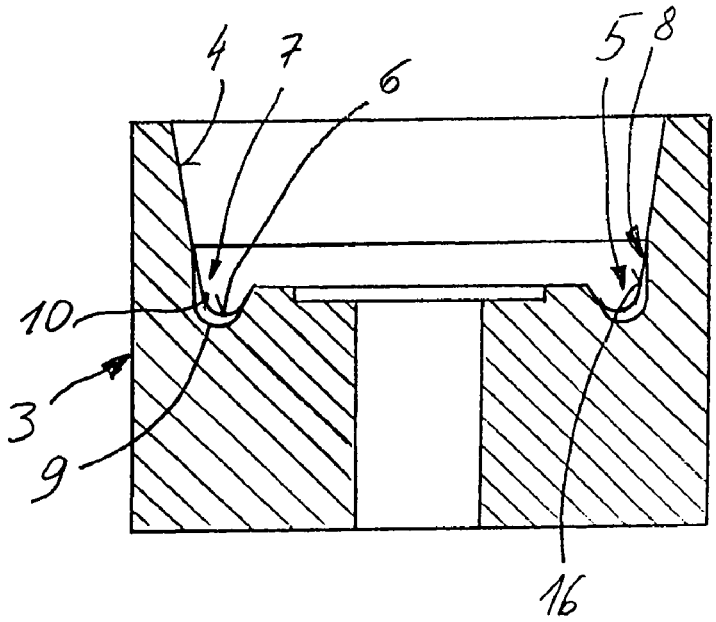
FIG. 2 is an axial section of an arrangement according to an embodiment of the present invention for rolling a bottom flange of a container jacket.
Figure 3:
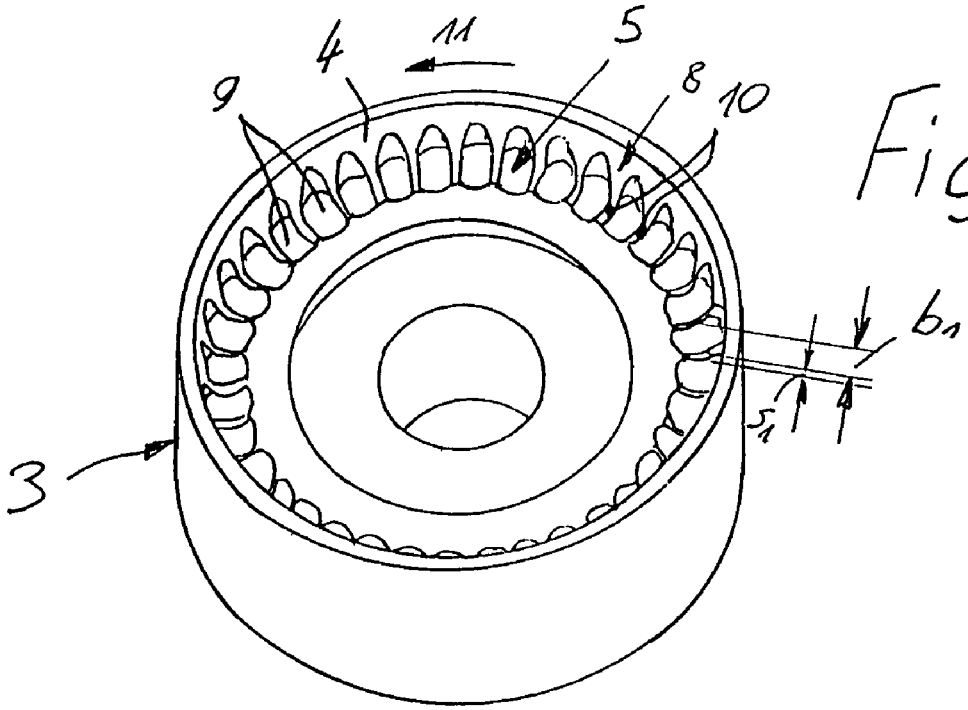
FIG. 3 is the arrangement of FIG. 2 as shown in a perspective view to demonstrate the pocket-like recesses and the rolling ridges.

FIGS. 2 and 3 show the arrangement 3 according to the present invention which is to be applied for rolling the frontal end 2 of the container jacket 1. The arrangement 3 is thus a forming die for the bottom area of the subsequently formed container.

The arrangement 3 comprises a supporting surface 4, which is supported from the outside on the container jacket 1 when it subsequently acts on the container jacket 1. In order to roll the frontal end 2 of the container jacket 1, a ring-shaped cavity 5 is provided in the arrangement 3, which cavity 5 is joined to the slightly conically extending supporting surface 4 and which comprises a closed bottom 6 as well as an open top 7 which is disposed opposite thereto. The cavity 5 has an essentially semicircular cross-section. In order to roll the frontal end 2, the arrangement 3 can act in axial direction on the container jacket 1.

In order to reduce the deformation forces, namely in such a way that every lubricant means is superfluous, the cavity 5 comprises at least in the transitional area 8 between the supporting surface 4 and the bottom 6 in circumferential direction 11 a plurality of pocket-shaped recesses 9, between which rolling ridges 10 remain. In many cases it is important that the pocket-shaped recesses 9 extend out over the floor of the bottom 6 and advantageously over the entire cavity 5.

Figure 4:
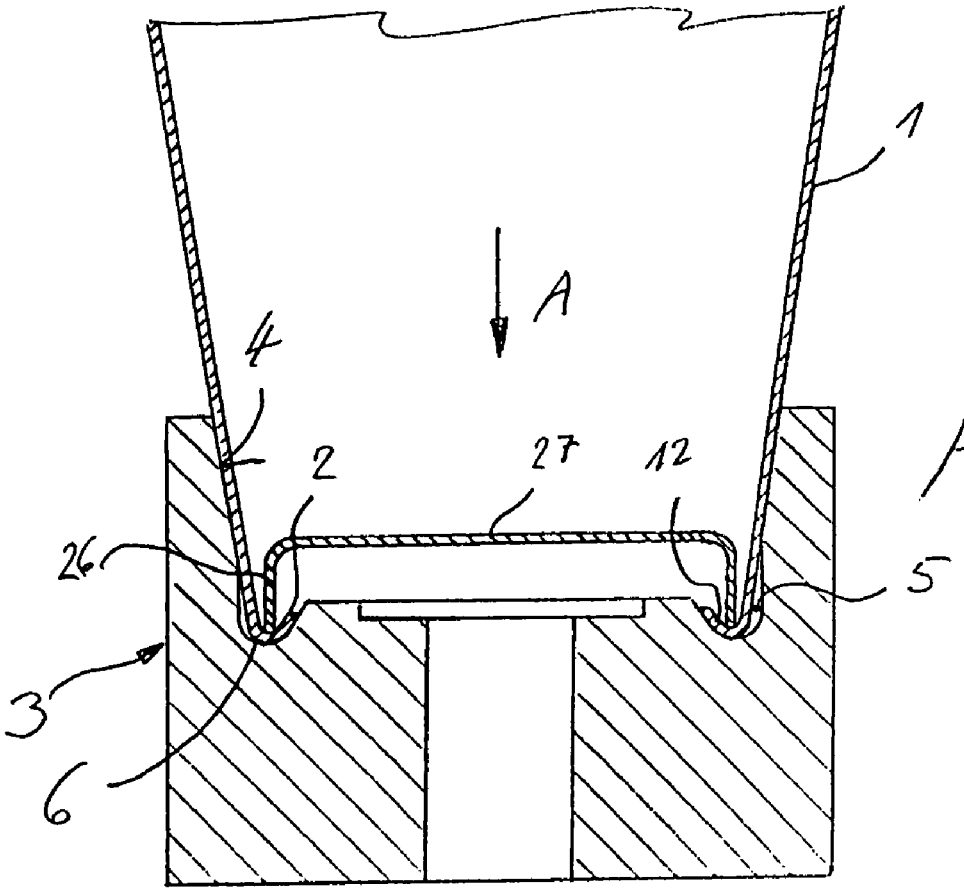
FIG. 4 shows the action of the arrangement of FIG. 3 on the container jacket of FIG. 1 during the rolling process.

It can be seen in FIG. 4 how the container jacket 1 is pressed into the cavity 5 of the arrangement 3 by an axial force A. It is, of course, possible to design the arrangement 3 so that it is mobile and to allow it to act on the stationarily mounted container jacket 1. As the rolling process according to FIG. 4 is carried out in the bottom area of the subsequent container, a one-step deformation process is sufficient. The still incomplete bottom flange 12 can be seen in FIG. 4.

Figure 5:
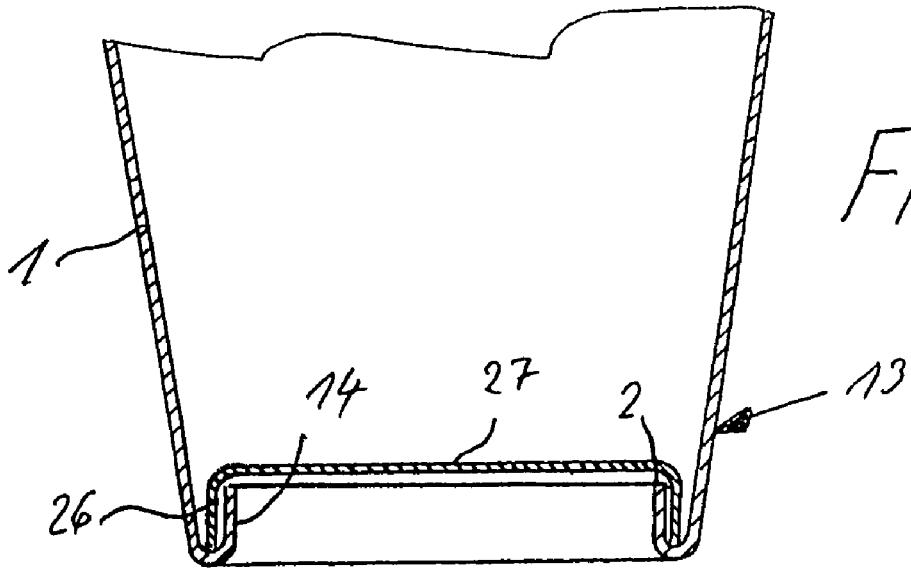
FIG. 5 shows the lower area of the rolled container jacket.

Because of the pocket-like recesses 9 with the rolling ridges 10 located therebetween which can be seen in FIG. 3, the deformation forces for the production of the bottom flange 12 are significantly reduced, without the need to apply a lubricant. At the end of the deformation process, the rolled container jacket 1 takes the form at its lower end which is shown in FIG. 5. The now finished bottom lip 14, which overlaps the edge 26 of the bottom 27, can be seen in the unfinished product 13 of the subsequent container.

The surface 16 (see FIG. 2) of at least the cavity 5 can be made of plastic in order to increase the desired effect of the present invention.

As can be seen in particular in FIG. 4, the cavity 5, on the basis of a supporting surface 4 supporting the container jacket 1 on the outside, is arranged radially towards the inside. The width b1 of the recesses 9 measures several times the width s of the rolling ridges 10. This is important in particular when rolling a bottom lip 14.

Figure 6:
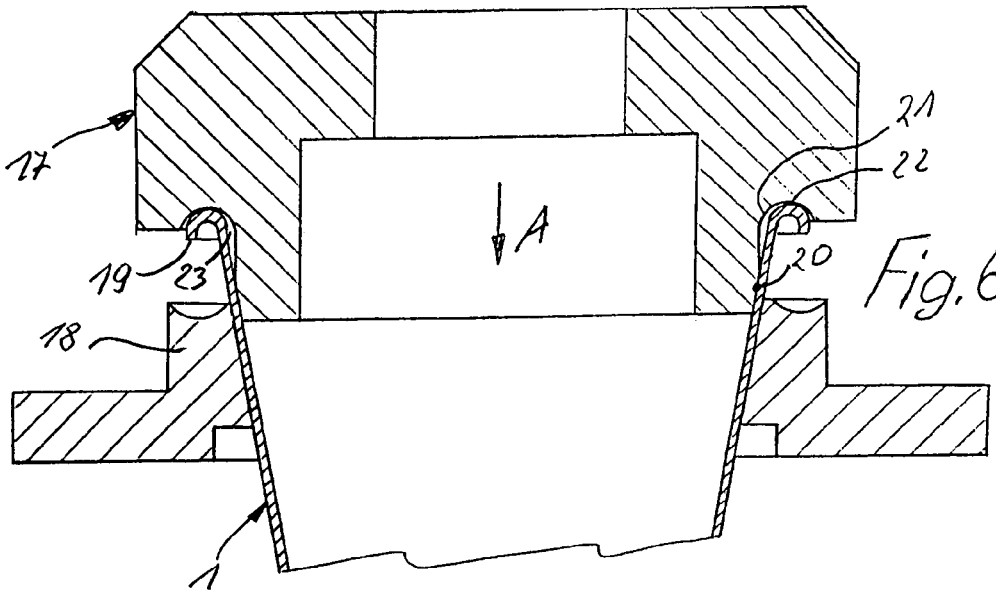
FIG. 6 is a view similar to FIG. 4 for the upper area of a container jacket, which is to be provided with a top lip.
Figure 7:
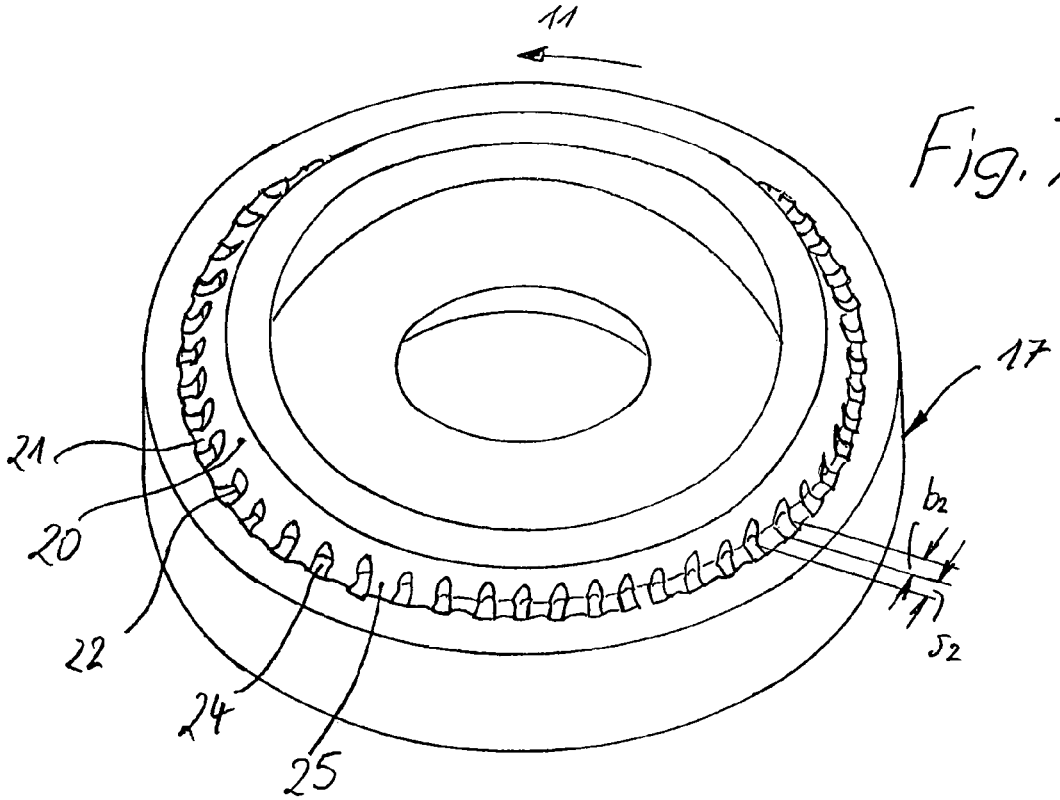
FIG. 7 is a perspective view of the device according to FIG. 6 to demonstrate the pocket-like recesses and the rolling ridges.

FIGS. 6 and 7 show how, in the case of a container jacket 1, the upper frontal end 19 can be rolled, for example for a first procedural step in the manufacture of a top lip. It can be seen how the axial force A acts with an arrangement 17 for rolling the top lip on a container jacket 1. In the present case, the arrangement 17 acts together with a holding device 18, which surrounds the container jacket 1 from the outside.

In FIG. 6, the frontal end 19 is already partially rolled up and can be deformed in further procedural steps to a completely closed top lip. A cavity 21 can again be seen in the arrangement 17, which is arranged to a supporting surface 20 which supports the inside of the container jacket 1, said cavity 21 having a closed bottom 22 and an open top 23. The cavity 21 in this case also has an essentially semicircular cross-section.

In the arrangement 17, the cavity 21 is provided at least in the transitional area between the supporting surface 20 and the bottom 22 in circumferential direction 11 with a plurality of pocket-like recesses 24, between which rolling ridges 25, as part of the original cavity 21 surface, remain. As can be seen in FIG. 7, the width b2 of the recesses 24 corresponds approximately to the width s2 of the rolling ridges 25 in the example shown. In the present case, on the basis of a supporting surface 20 supporting the container jacket 1 on the inside, the cavity 21 extends radially outwards. For the rolling of a lip, the width of the recesses can, of course, measure several times that of the width of the rolling ridges.

In the case of containers, which are made from a container jacket 1, the arrangements 3 and 17 act one after the other on the container jacket 1. In this way the bottom lip 14 and a top lip can be formed successively on the container jacket 1.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An arrangement for rolling a front end of a deformable sleeve-shaped container jacket, comprising a supporting surface which radially supports the container jacket in the area of the front end, also comprising, radially adjacent to the supporting surface, a ring-shaped cavity having a closed bottom and an open top, which cavity has an essentially semicircular cross-section for acting axially, without rotation, on the front end of the container jacket, wherein the cavity is provided in a circumferential direction at least in a transitional area between the supporting surface and the bottom with a plurality of pocket-shaped recesses, between which rolling ridges remain, the rolling ridges each having a container rolling surface, wherein for given heights above the bottom, points on each of the container rolling surfaces describe a perimeter of a constant radius circle parallel to the bottom and centered on an axis of the ring shared cavity.

2. An arrangement according to claim 1, wherein at least the cavity comprises a surface made of plastic.

3. An arrangement according to claim 1, wherein the supporting surface supports the container jacket on the inside of the container jacket, the cavity is arranged to deform the container jacket radially outwards.

4. An arrangement according to claim 3, wherein a width of the recesses corresponds approximately to a width of the rolling ridges.

5. An arrangement according to claim 3, wherein a width of the recesses measures at least twice a width of the rolling ridges.

6. An arrangement according to claim 3, wherein the recesses extend over the bottom of the cavity.

7. An arrangement according to claim 6, wherein the recesses are distributed over the entire circumference of the cavity.

8. An arrangement for rolling a front end of a deformable sleeve-shaped container jacket, comprising:

a supporting surface which radially supports the container jacket; and a cavity configured to receive the front end of the container jacket when the cavity is adjacent to an end of the supporting surface, the cavity having a closed bottom, an open top, and an essentially semicircular cross-section for receiving and acting axially, without rotation, on the front end of the container jacket, and being shaped to substantially conform to a shape of said end of the supporting surface, wherein, at least in a transitional area in the cavity between the cavity top and bottom, a plurality of pocket-shaped recesses are arranged about the cavity, with rolling ridges present between adjacent recesses, and wherein the rolling ridges each have a container rolling surface, and for given heights above the bottom, points on the container rolling surface describe a perimeter of a constant radius circle parallel to the bottom and centered on an axis of the cavity.

9. An arrangement for rolling a front end of a deformable sleeve-shaped container jacket, comprising a supporting surface which radially supports the container jacket in the area of the front end, also comprising, radially adjacent to the supporting surface, a ring-shaped cavity having a closed bottom and an open top, which cavity has an essentially semicircular cross-section for acting axially, without rotation, on the front end of the container jacket, wherein the cavity is provided in a circumferential direction at least in a transitional area between the supporting surface and the bottom with a plurality of pocket-shaped recesses, between which rolling ridges remain, the rolling ridges each having a container rolling surface, wherein circumferentially adjacent points along each container rolling surface, for given heights above the bottom, describe a perimeter of a constant radius circle parallel to the bottom and centered on an axis of the ring shared cavity.

* * * * *